US008769997B2

(12) United States Patent
Moon et al.

(10) Patent No.: US 8,769,997 B2
(45) Date of Patent: Jul. 8, 2014

(54) LAUNDRY MACHINE

(75) Inventors: Jung Wook Moon, Gyeongsangnam-do (KR); Chang Gyu Choi, Gyeongsangnam-do (KR); Hye Yong Park, Gyeongsangnam-do (KR); Seung Gyu Ryu, Gyeongsangnam-do (KR); Kwang Hee Lee, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 1093 days.

(21) Appl. No.: 12/415,349

(22) Filed: Mar. 31, 2009

(65) Prior Publication Data

US 2009/0249839 A1 Oct. 8, 2009

(30) Foreign Application Priority Data

Apr. 2, 2008 (KR) ..... 10-2008-0030696

(51) Int. Cl.
*D06F 31/00* (2006.01)
*D06B 1/00* (2006.01)

(52) U.S. Cl.
USPC ..... 68/5 C; 68/3 R; 68/5 R

(58) Field of Classification Search
USPC ..... 68/3 R, 5 C, 5 R, 20
See application file for complete search history.

(56) References Cited

U.S. PATENT DOCUMENTS

| | | | | |
|---|---|---|---|---|
| 5,305,484 | A * | 4/1994 | Fitzpatrick et al. | 8/149.3 |
| 2002/0017117 | A1* | 2/2002 | Sunshine et al. | 68/3 R |
| 2004/0134237 | A1* | 7/2004 | Sunshine et al. | 68/3 R |
| 2006/0150689 | A1* | 7/2006 | Kim et al. | 68/236 |
| 2006/0151009 | A1* | 7/2006 | Kim et al. | 134/42 |
| 2006/0201209 | A1* | 9/2006 | Lee et al. | 68/5 C |
| 2008/0053166 | A1 | 3/2008 | Lim | |

FOREIGN PATENT DOCUMENTS

| | | | |
|---|---|---|---|
| CN | 101139791 | A | 3/2008 |
| EP | 1 895 039 | A2 | 3/2008 |
| KR | 10-2008-0019847 | A | 3/2008 |

* cited by examiner

*Primary Examiner* — Michael Barr
*Assistant Examiner* — Benjamin L Osterhout
(74) *Attorney, Agent, or Firm* — Birch, Stewart, Kolasch & Birch, LLP

(57) ABSTRACT

A laundry machine is disclosed. A laundry machine includes a main laundry machine washing or drying laundry and an auxiliary laundry machine comprising a body installed in a predetermined portion of the main laundry machine, a drawer detachably from the body and a steam supply device installed in the main laundry machine, the drawer supplying steam to the drawer selectively.

16 Claims, 5 Drawing Sheets

LAUNDRY MACHINE

CROSS REFERENCE TO RELATED APPLICATION

This application claims the benefit of the Patent Korean Application No. 10-2008-0030696, filed on Apr. 2, 2008, which is hereby incorporated by reference as if fully set forth herein.

BACKGROUND OF THE DISCLOSURE

1. Field of the Disclosure

The present invention relates to a laundry machine. More particularly, the present invention relates to a laundry machine including a main laundry machine and an auxiliary laundry machine useable together with the main laundry machine.

2. Discussion of the Related Art

Laundry machines typically refer to electric home appliances having a washing, drying and washing or drying function. That is, laundry machines can perform either or both of washing and drying. In recent, such the laundry machines tend to be manufactured with a large capacity according to consumer demands.

However, there would be washing machines of such the laundry machines with no drying function. A user using only such the washing machine with no drying function has to purchase an auxiliary dryer or a new washing machine having drying and washing functions.

Moreover, because of the trend of enlarged laundry machines, the user has to operate the laundry machine with the large capacity to dry a relatively small amount of laundry. As a result, the conventional laundry machines have a disadvantage as a matter of energy efficiency.

SUMMARY OF THE DISCLOSURE

Accordingly, the present invention is directed to a laundry machine.

An object of the present invention is to provide a laundry machine including an auxiliary laundry machine capable of treating a small amount of laundry, without operating a main laundry machine, to enhance energy efficiency and user convenience.

Another object of the present invention is to provide an auxiliary laundry machine capable of securing an inner space receiving laundry as much as possible and a laundry machine including the same.

A still further object of the present invention is to provide an auxiliary laundry machine capable of sanitizing or sterilizing a small amount of laundry, which the conventional washing machine is difficult to treat, for example, dolls or teddy bears for children, using steam or hot air, and a laundry machine including the same.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry machine includes a main laundry machine washing or drying laundry; and an auxiliary laundry machine comprising a body installed in a predetermined portion of the main laundry machine, a drawer detachably from the body and a steam supply device installed in the main laundry machine, the drawer supplying steam to the drawer selectively.

The auxiliary laundry machine may be provided under the main laundry machine and the steam supply device is installed in a lower portion inside the main laundry machine.

The steam supply device may be installed at a predetermined portion of an inner lower surface of the main laundry machine, aside from a center.

The steam supply device may supply steam to the main laundry machine and the auxiliary laundry machine simultaneously or selectively.

The steam supply device may include an outlet pipe discharging steam; a first branched pipe branched from the outlet pipe and supplying steam to the main laundry machine; a second branched pipe branched from the outlet pipe and supplying steam to the auxiliary laundry machine; and a valve connecting the first branched pipe and the second branched pipe with the outlet pipe simultaneously or selectively.

The steam supply device may include a first steam supply device supplying steam to the auxiliary laundry machine and a second steam supply device supplying steam to the main laundry machine. The first steam supply device and the second steam supply device may be provided in the main laundry machine.

The auxiliary laundry machine may be provided under the main laundry machine and the auxiliary laundry machine may further include an air supply unit installed in a lower portion of the main laundry machine, the air supply unit supplying air to the drawer.

The air supply unit may include a fan sucking and ventilating air inside the main laundry machine, a duct guiding the air sucked by the fan to be discharged to the auxiliary laundry machine, and a heater installed in the duct, the heater heating the air discharged to the body of the auxiliary laundry machine.

The fan may adjust the rotational number and the heater may adjust the temperature.

The air supply unit may further include a housing covering the fan and the duct and at least one air inlet may be formed at a predetermined portion of the housing and at least one air outlet may be formed at the other portion of the housing.

The air supply unit may further include a communication member connecting the air outlet with the body.

The drawer may include a first space receiving steam from the steam supply device and a second space receiving air from the air supply unit, the second space partitioned off from the first space selectively.

In another aspect of the present invention, a laundry machine includes a main laundry machine washing or drying laundry; and an auxiliary laundry machine including a body installed in a predetermined portion of the main laundry machine, a drawer receiving laundry, the drawer detachable from the body, and an air supply unit installed in the main laundry machine, the air supply unit supplying hot air to the drawer selectively.

The auxiliary laundry machine may be provided under the main laundry machine and the air supply unit may be installed in a lower portion inside the main laundry machine.

The air supply unit may be installed in a predetermined portion of an inner lower surface of the main laundry machine, aside from a center.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
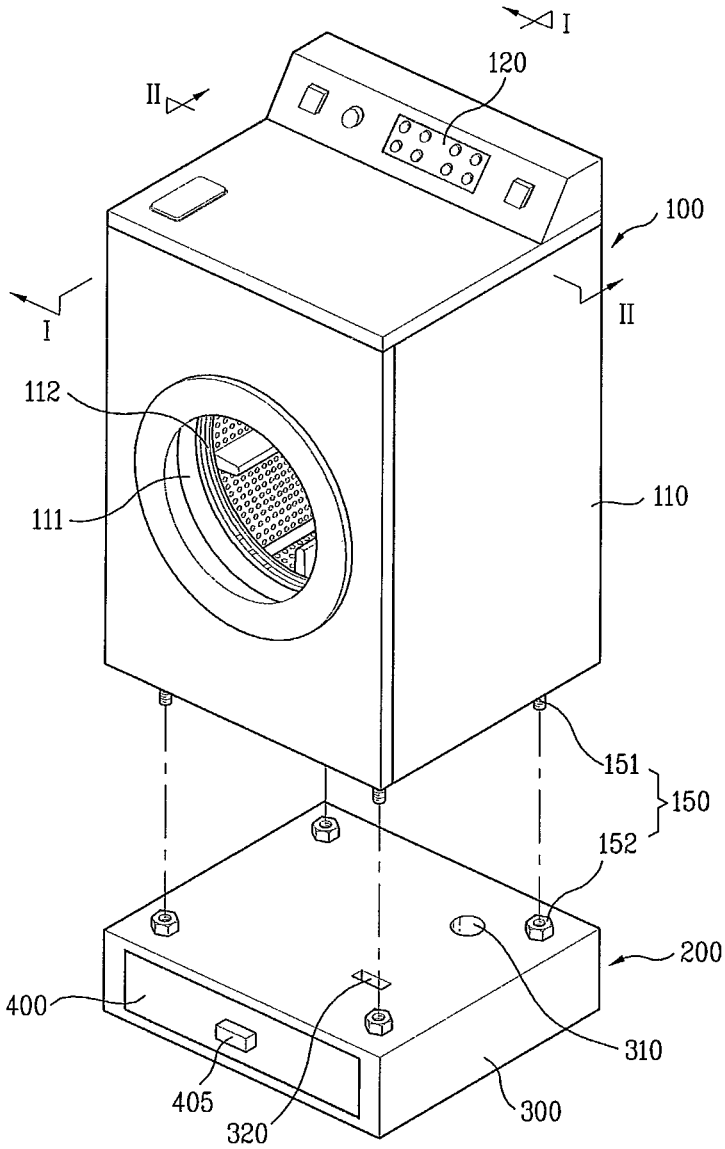
FIG. 1 is a perspective view illustrating a laundry machine according to an exemplary embodiment of the present invention.
Figure 2:
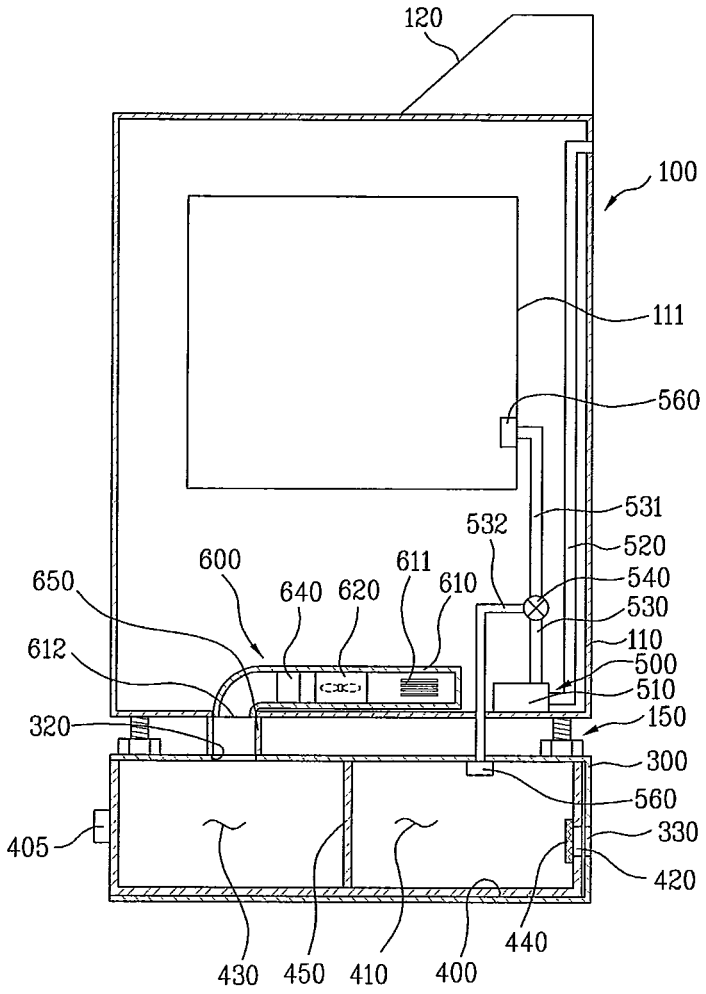
FIG. 2 is a sectional view of the laundry machine cut away along I-I line of FIG. 1.
Figure 3:
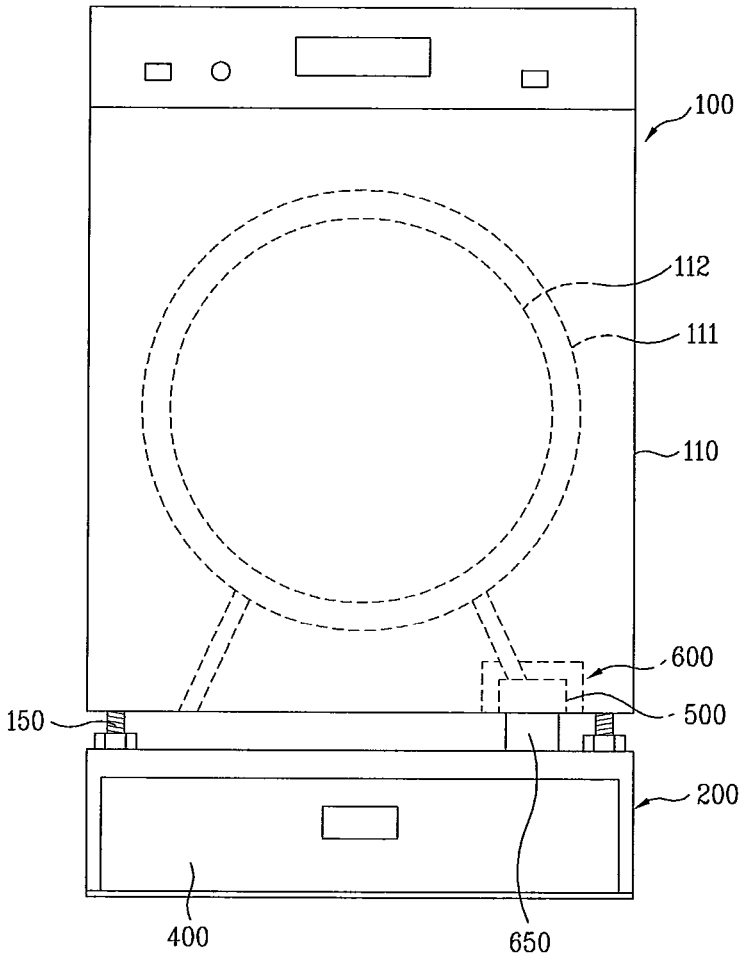
FIG. 3 is a sectional view cut away along H-H line of FIG. 1.

FIG. 1 is a perspective view illustrating a laundry machine according to an exemplary embodiment of the present invention. FIG. 2 is a sectional view of the laundry machine cut away along I-I line of FIG. 1. FIG. 3 is a sectional view cut away along II-II line of FIG. 1.

In reference to FIG. 1, a laundry machine according to an exemplary embodiment of the present invention includes a main laundry machine 100 and an auxiliary laundry machine 200 installed under the main laundry machine 100.

According to this embodiment, the auxiliary laundry machine 200 is installed under the main laundry machine 200 and it supports the main laundry machine 200. However, the present invention is not limited to the above configuration and the auxiliary laundry machine 200 may be installed on or next to the main laundry machine 100.

Also, this embodiment presents a drum type washing machine as the main laundry machine 100 and the present invention is not limited thereto. The main laundry machine 100 may be a dryer or drum type washing machine having a drying function as well as a drum type washing machine.

The main laundry machine 100 includes a cabinet 110 defining an exterior appearance thereof and a drum 112 rotatable within a tub 111. Here, if the main laundry machine 100 is configured of a dryer, only the drum 112 is provided and it receives laundry therein. If the main laundry machine 100 is configured of a drum type washing machine or a washing machine having a drying function, the tub 111 may be further provided in the cabinet 110 and it receives wash water therein.

In addition, a control panel 120 is installed at a top of the cabinet 110 although not shown in the drawings, there may be provided at the control panel 120 a power part controlling the power applied to the main laundry machine 100, a display part displaying an operational state of the main laundry machine 100 and a control part controlling an overall washing course of the main laundry machine 100.

The main laundry machine 100 according to this embodiment may include a securing means 150 capable of connecting the auxiliary laundry machine 200 to the main laundry machine 100 securely. The securing means 150 may include a plurality of legs 151 and a plurality of fastening member 152. The plurality of the legs 151 may be formed at a bottom of the main laundry machine 100 and they support the main laundry machine 100. The plurality of the fastening members 152 may be formed at a top of the auxiliary laundry machine 200 and they are fastened to the legs 151, respectively.

The auxiliary laundry machine 200 installed under the main laundry machine 100 includes a body 300 secured to the cabinet 110 of the main laundry machine 100 by the securing mean 150 and it may further include a drawer 400 detachable from the body 300. A predetermined space is formed in the drawer 400 and laundry is accommodated in the space.

The cabinet 110 of the main laundry machine may includes at least one of a steam supply device (500, see FIG. 2) and an air supply unit (600, see FIG. 3). The steam supply device 500 supplies steam to the auxiliary laundry machine 200 and the air supply unit 600 supplies hot air to the auxiliary laundry machine 200.

In reference to FIGS. 2 and 3, the body 300 of the auxiliary laundry machine 200 has a rectangular parallelepiped shape with an open front where the detachable drawer 400 is provided and it is formed of material having an enough rigid and strength to support the main laundry machine 100.

At an upper surface of the body 300 may be formed a through hole 310 and an inlet 320 and an outlet 330. The steam supplied by the steam supply device 500 installed in the cabinet of the main laundry machine 100 is drawn into the body 300 through the through hole 310. The air supplied by the air supply unit 600 is drawn into the body 300 through the inlet and the steam or air drawn into the body 300 is discharged through the outlet 330.

The drawer 400 is detachably provided in the body 300, sliding forward and rearward and a top of the drawer 400 is open to receive the laundry. A handle 405 may be installed at a front of the drawer 400 to slide the drawer 400 smoothly.

Once the drawer 400 is insertedly sliding into the body 300, an upper end of the drawer 400 is in close contact with the body 300 such that an airtight space is formed between the body 300 and the drawer 400. This is to maximize an effect of the steam or hot air supplied into the drawer 400, which will be described in detail later.

An outlet hole 420 is provided at a rear of the drawer 400 and the air drawn into the drawer 400 is discharged through the outlet hole 420. The outlet hole 420 is corresponding to the outlet 330 formed at the rear of the body 300 such that the air drawn into the drawer 400 is discharged smoothly and quickly. Here, a filter 440 may be installed at the outlet hole 420 to filter foreign matters, for example, lint discharged through the outlet hole 420 and it is preferable that the filter 440 is a deodorizing filter capable of foreign matters generating unpleasant smell of the laundry.

As mentioned above, the laundry machine according to this embodiment may include at least one of the steam supply device 500 and the air supply unit 600 which supply steam and hot air to the auxiliary laundry machine 200, respectively. In this case, the steam supply device 500 and the air supply unit 600 may be installed in the main laundry machine 100, not in the auxiliary laundry machine 200.

As the steam supply device 500 and the air supply unit 600 are installed in the main laundry machine 100, spare space inside the main laundry machine 100 may be utilized and the auxiliary laundry machine 200 may be compact, with a maximum space inside the drawer 400 where the laundry is accommodated.

In reference to FIG. 2, the steam supply device 500 includes a case 510 receiving a heater, an inlet pipe 520 and an outlet pipe 530. Water is drawn into the case 510 via the water inlet pipe 520 and steam generated in the case 510 is discharged via the outlet pipe 530. The steam supply device 500 may further include a first branched pipe 531 and a second branched pipe 532. The first branched pipe 531 is branched from the outlet pipe 530 and connected with the tub 111 of the main laundry machine 100 to supply steam to the tub 111. The second branched pipe 532 is branched from the outlet pipe 530 and connected with the body 300 of the auxiliary laundry machine 200 to supply steam to the drawer 400. A nozzle 560 is provided at each end of the first and second branched pipes 531 and 532 to spray steam uniformly.

A valve 540 may be provided at a branching portion of the first and second branched pipes 531 and 532 and the valve 540 adjusts steam to flow along the first and second branched pipes 531 and 532 simultaneously and selectively.

As a result, when only the main laundry machine 100 is operating, only the first branched pipe 531 is connected with the outlet pipe 530. When only the auxiliary laundry machine 200 is operating, only the second branched pipe 532 is connected with the outlet pipe 530. When both the laundry machines 100 and 200 are operating simultaneously, the first and second branched pipes 531 and 532 are connected with the outlet pipe 530 simultaneously.

The single steam supply device 500 is useable to both of the main laundry machine 100 and the auxiliary laundry machine 200 and this enables the production cost of the laundry machine to be reduced.

If they are provided in the cabinet 110 as shown in FIG. 3, the steam supply device 500 and the air supply unit 600 may be provided in a lower portion of the cabinet 110, specifically, a bottom of the cabinet 110. If then, the steam supply device 500 and the air supply unit 600 may be installed aside from a center of the bottom, not a portion of the bottom under a center of the tub 111. The tub ill has a relatively much space in both side portions because it is cylinder-shaped. As a result, the steam supply device 500 and the air supply unit 600 are installed in a predetermined side portion from the center of the tub 111, such that the spare space inside the cabinet 110 may be utilized without increasing the height of the cabinet 110.

Figure 4:
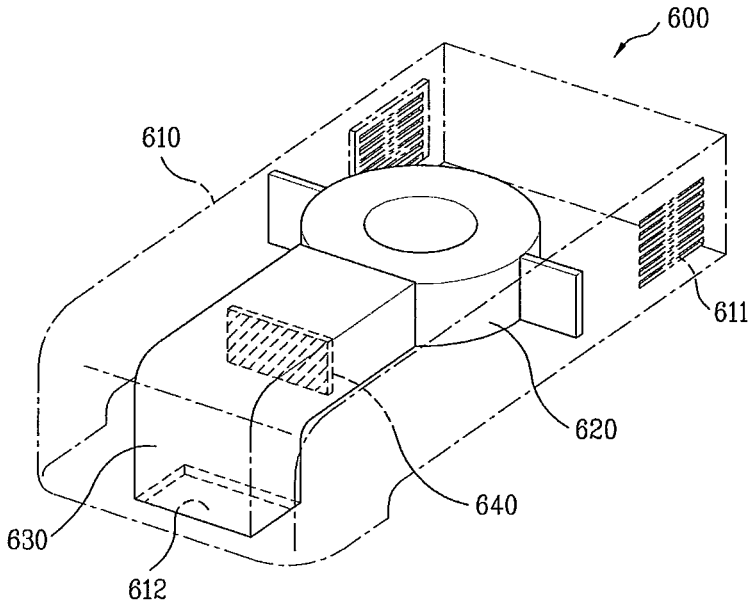
FIG. 4 is a perspective view illustrating an air supply unit shown in FIG. 2.

FIG. 4 is a perspective view illustrating the air supply unit 600.

In reference to FIG. 4, the air supply unit 600 includes a fan 620, a duct 630 and a heater 640. The fan 620 sucks and blows the air inside the main laundry machine 100. The duct 630 guides the air sucked by the fan 620 to be discharged into the body 300 of the auxiliary laundry machine 200. The heater 640 is installed in the duct 630 to heat the air discharged into the body 300 of the auxiliary laundry machine 200.

It is preferable that the air supply unit 600 includes a housing 610 covering the fan 620 and the duct 630. The housing 610 is formed longitudinal along a forward and rearward direction. At least one air inlet 611 may be formed at a predetermined portion of the housing 610 and an air outlet 612 may be formed at another predetermined portion of the housing 610.

The amount of the ventilated air is variable according to the rotation number of the fan 620. Because of that, if the amount of the laundry received in the drawer 400 is relatively large, a relatively large amount of air is sucked into the drawer 400 and the sucked air is discharged quickly. As a result, the time taken to dry or deodorize the laundry may be reduced.

The heater 640 may be classified into an electric type and gas type. Considering the auxiliary laundry machine 200 of the present invention, it is preferable that the heater 640 is a small-sized electric type and it is more preferable that the heater 640 is a sheath heater or PTC (Positive Temperature Coefficient) heater.

In addition, the heater may be one capable of adjusting the temperature of the air heated therein. This is to adjust the temperature of the air drawn into the drawer 400 according to the kind of the fabric or the amount of the laundry received in the drawer 400.

In reference to FIGS. 2 and 3 again, the air supply unit 600 is installed in the main laundry machine 100, specifically, the bottom of the cabinet 110 of the main laundry machine 100 and the bottom of the cabinet 110 is spaced apart a predetermined distance from the top of the auxiliary laundry machine 200 by the securing means 150. Thus, it is preferable that a communication member 650 is further provided to communicate the air outlet 612 of the air supply unit 600 with the inlet 320 of the body 300.

As mentioned above, at the top of the body 300 of the auxiliary laundry machine 200 may be formed the through hole 310 connected with the steam supply device 500 to draw steam and the inlet 320 connected with the air supply unit 600 to draw hot air. To secure the installation space of the steam supply device 500 and the air supply unit 600, either of the through hole 310 and the inlet 320 may be formed at a front portion of the top of the body 300 and the other may be formed at a rear portion of the top of the body 300.

In the meanwhile, the drawer 400 may include a partition 450 capable of partitioning its inner space into a first space 410 in communication with the through hole 310 and a second space 430 in communication with the inlet 320. Here, it is preferable that the partition 450 may be detachably coupled to the drawer 400.

The user can operate an operation part (not shown) for air or steam to be drawn into the drawer 400. Since the inner space of the drawer 400 is partitioned by the partition 450, the effect of the refreshing by the air or steam may be maximized as possible.

For example, if desiring to treat the laundry, using only steam, the user loads the laundry in the first space 410 and inputs a corresponding command to operate only the steam supply device 500. As a result, energy efficiency and laundry treating efficiency may be enhanced because the steam is sprayed into the small first space 410 intensively. Such the steam supplying may cause a sanitary effect because of the high temperature of the steam. By extension, if steam is supplied to the washed laundry, a wrinkle removal effect may be expected.

Also, for example, if desiring to treat the laundry, using only the hot air, the user loads the laundry in the second space 430 and inputs a corresponding command to operate only the air supply unit 600. As a result, energy efficiency and laundry treating efficiency may be enhanced because the hot air is supplied into the small second space 430 intensively.

In the case of supplying hot air to the second space 430, the second space 430 is partitioned off from the first space 410 by the partition 450 and an auxiliary configuration capable of exhausting the hot air supplied to the second space 430, for example, a second outlet hole (not shown) may be provided at the drawer 400 and a second outlet (not shown) corresponding to the second outlet hole of the drawer 400 may be further provided at the body 300.

When refreshing the laundry, using both of the hot air and steam, the partition 450 is removed from the drawer 400 and both of them are operated simultaneously.

Here, the auxiliary laundry machine 200 may include a power part (not shown) supplying the electricity thereto, a control part (not shown) controlling the steam supply device 500 and the air supply unit 600, and a display part (not shown) displaying an operational state thereof.

The power, control and display parts may be formed at the control panel 120 of the main laundry machine 100. However, it is preferable that they are formed at a front of the auxiliary laundry machine 200 independently.

Especially, if the control part is formed at the control panel 120 of the main laundry machine 100, the control part may control both the main laundry machine 100 and the auxiliary laundry machine 200. If the control part is formed at the auxiliary laundry machine 200 independently, the control part may control the steam supply device 500 and the air supply unit 600, separate from the control part of the main laundry machine 100.

Figure 5:
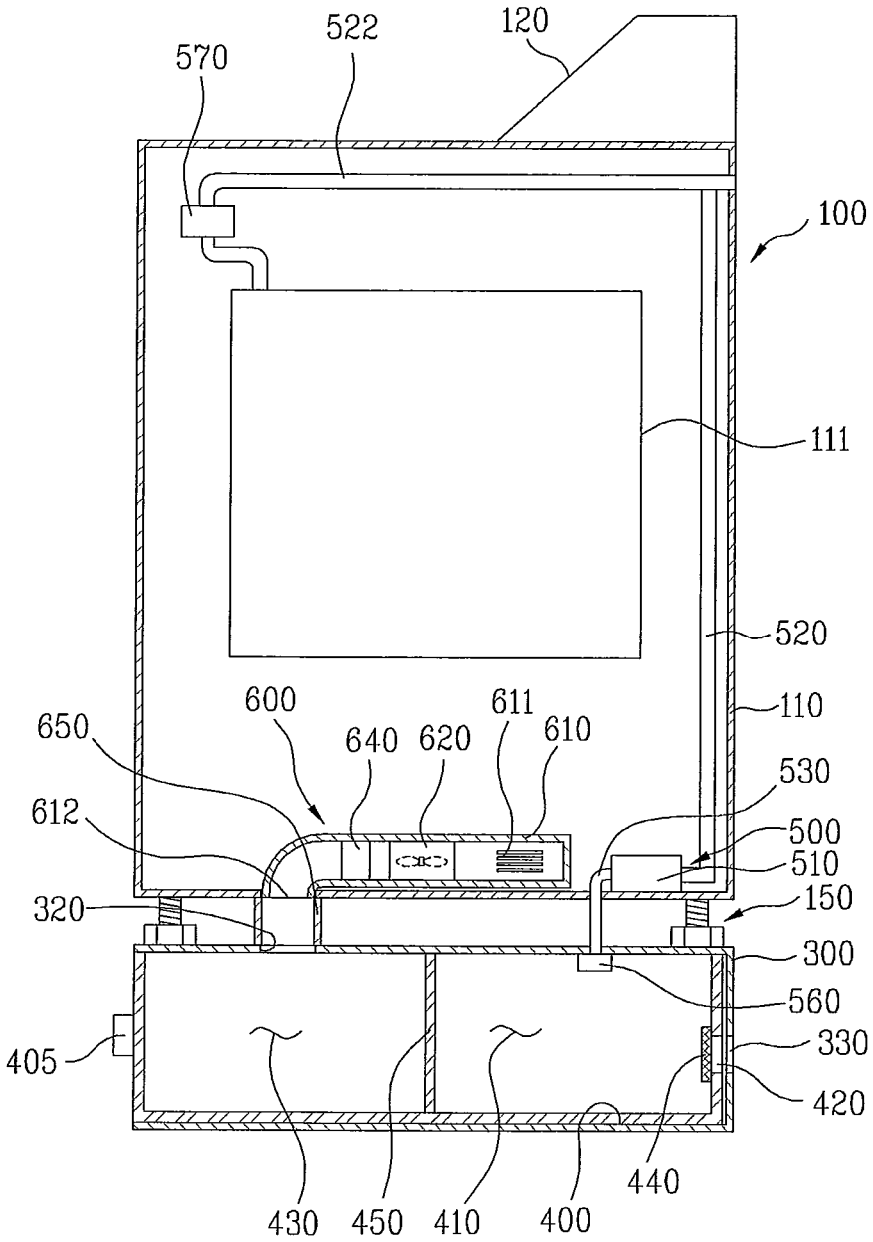
FIG. 5 is a sectional view illustrating a sectional view illustrating a laundry machine according to another embodiment of the present invention.

FIG. 5 illustrates a laundry machine according to another embodiment of the present invention.

Compared with the laundry machine according to the above embodiment, the laundry machine shown in FIG. 5 has a different aspect in that configurations for supplying steam to the main laundry machine and the auxiliary laundry machine are provided separately. Next, the different aspect will be described in detail.

In reference to FIG. 5, the laundry machine according to this embodiment includes a first steam supply device 500 and a second steam supply device 570 as steam supply unit. The first steam supply device 500 supplies steam to the drawer and the second steam supply device 570 supplies steam to the main laundry machine 100.

Even if the first and second steam supply devices 500 and 570 are provided, it is preferable that the first steam supply device 500 supplying steam to the drawer is provided in the main laundry machine 100 such that the capacity of the auxiliary laundry machine 200 may be enlarged, with utilizing space inside the main laundry machine 100.

If the steam supply devices 500 and 570 are provided in the main laundry machine 100 and the auxiliary laundry machine 200, respectively, the capacities of the first and second steam supply devices 500 and the 570 may be small.

Specifically, if supplying steam to both of the main laundry machine 100 and the auxiliary laundry machine 200 as mentioned above, the capacity of the single steam supply device has to be large. Correspondingly, the capacity of the heater heating the water to be supplied to the steam supply device has to be large.

While, according to this embodiment, the steam supply devices are provided in the main laundry machine 100 and the auxiliary laundry machine 200, respectively. Compared with the above embodiment presenting the large-sized steam supply unit, this embodiment enables the small-sized steam supply device. In addition, it may be easier to control the steam supply devices with the small capacities than the steam supply device with the large capacity.

The first and second steam supply devices 500 and 570 may include a first inlet pipe 520 and a second inlet pipe 522, respectively.

As mentioned above, the auxiliary laundry machine according to the present invention can simply sanitize or refresh substantially small-sized laundry which is difficult to treat by using the conventional washing machine, for example, dolls and teddy bears for children.

Furthermore, the steam supply device 500 and the air supply unit 600 are installed in the main laundry machine 100, not in the auxiliary laundry machine 200. As a result, the auxiliary laundry machine 200 may be compact and the inner space of the drawer 400 receiving the laundry may be secured as much as possible.

Therefore, the laundry machine according to the present invention has following advantages.

According to the auxiliary laundry machine and the laundry machine including the same, small-sized laundry may be dried without an operation of the main laundry machine. As a result, energy efficiency may be enhanced, with improved convenience.

Furthermore, the air supply unit is installed in the main laundry machine, not in the auxiliary laundry machine. As a result, the inner space of the auxiliary laundry machine where the laundry is received may be secured as much as possible.

A still further, the small-sized laundry which is difficult to treat by using the conventional washing machine may be treated simply and thus user convenience may be enhanced.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine comprising:

a main laundry machine washing or drying laundry; and an auxiliary laundry machine comprising:

a body installed in a predetermined portion of the main laundry machine;

a drawer detachable from the body;

a steam supply device provided in the main laundry machine, the steam supply device selectively supplying steam into the drawer; and an air supply unit provided at a bottom surface of a cabinet of the main laundry machine, the air supply unit selectively supplying hot air only to the auxiliary laundry machine, wherein the auxiliary laundry machine is provided under the main laundry machine and the auxiliary laundry machine further comprises an air supply unit provided in a lower portion of the main laundry machine, the air supply unit supplying air to the auxiliary laundry machine, wherein the air supply unit includes a housing having a space in which a fan and a duct are disposed, the fan blowing air to the duct, and wherein the heater is installed in the duct, and the duct is in the housing, and wherein the drawer comprises a first space receiving steam from the steam supply device and a second space receiving air from the air supply unit, the second space partitioned off from the first space selectively.

2. The laundry machine of claim 1, wherein the auxiliary laundry machine is provided under the main laundry machine and the steam supply device is provided in a lower portion inside the main laundry machine.

3. The laundry machine of claim 2, wherein the steam supply device is provided at a predetermined portion of an inner lower surface of the main laundry machine, aside from a center.

4. The laundry machine of claim 1, wherein the steam supply device supplies steam to the main laundry machine and the auxiliary laundry machine simultaneously or selectively.

5. The laundry machine of claim 4, wherein the steam supply device comprises:

an outlet pipe discharging steam;

a first branched pipe branched from the outlet pipe and supplying steam to the main laundry machine;

a second branched pipe branched from the outlet pipe and supplying steam to the auxiliary laundry machine; and a valve connecting the first branched pipe and the second branched pipe with the outlet pipe simultaneously or selectively.

6. The laundry machine of claim 1, wherein the steam supply device comprises:

a first steam supply device supplying steam to the auxiliary laundry machine; and a second steam supply device supplying steam to the main laundry machine, wherein the first steam supply device and the second steam supply device are provided in the main laundry machine.

7. The laundry machine of claim 1, wherein the air supply unit comprises a fan sucking and ventilating air inside the main laundry machine, a duct guiding the air sucked by the fan to be discharged to the auxiliary laundry machine, and a heater provided in the duct, the heater heating the air discharged to the auxiliary laundry machine.

8. The laundry machine of claim 7, wherein the fan is configured to adjust the rotational number and the heater is configured to adjust the temperature.

9. The laundry machine of claim 7, wherein the air supply unit further comprises a housing covering the fan and the duct and at least one air inlet is provided at a predetermined portion of the housing and at least one air outlet is provided at the other portion of the housing.

10. The laundry machine of claim 9, wherein the air supply unit further comprises a communication member connecting the air outlet with the body.

11. The laundry machine of claim 1, wherein the air supply unit is provided in a predetermined portion of an inner lower surface of the main laundry machine, aside from a center.

12. A laundry machine comprising: a main laundry machine washing or drying laundry; and an auxiliary laundry machine comprising:

a body installed in a predetermined portion of the main laundry machine; a drawer detachable from the body;

a steam supply device provided in the main laundry machine, the steam supply device selectively supplying steam into the drawer; and an air supply unit provided in a lower portion of the main laundry machine, the air supply unit supplying air to the auxiliary laundry machine, wherein the auxiliary laundry machine is provided under the main laundry machine, and wherein the drawer comprises a first space receiving steam from the steam supply device and a second space receiving air from the air supply unit, the second space partitioned off from the first space.

13. The laundry machine of claim 12, wherein the auxiliary laundry machine is provided under the main laundry machine and the steam supply device is provided in a lower portion inside the main laundry machine.

14. The laundry machine of claim 12, wherein the steam supply device supplies steam to the main laundry machine and the auxiliary laundry machine simultaneously or selectively.

15. The laundry machine of claim 14, wherein the steam supply device comprises: an outlet pipe discharging steam;

a first branched pipe branched from the outlet pipe and supplying steam to the main laundry machine;

a second branched pipe branched from the outlet pipe and supplying steam to the auxiliary laundry machine; and a valve connecting the first branched pipe and the second branched pipe with the outlet pipe simultaneously or selectively.

16. The laundry machine of claim 12, wherein the steam supply device comprises: a first steam supply device supplying steam to the auxiliary laundry machine; and a second steam supply device supplying steam to the main laundry machine, wherein the first steam supply device and the second steam supply device are provided in the main laundry machine.

* * * * *